United States Patent [19]

Brill

[11] Patent Number: 4,997,623

[45] Date of Patent: Mar. 5, 1991

[54] HEAT-DEFORMABLE, AUSTENITIC NICKEL-CHROMIUM-IRON ALLOY WITH HIGH OXIDATION RESISTANCE AND THERMAL STRENGTH

[75] Inventor: Ulrich Brill, Dinslaken, Fed. Rep. of Germany

[73] Assignee: VDM Nickel-Technologie AG, Werdohl, Fed. Rep. of Germany

[21] Appl. No.: 491,182

[22] Filed: Mar. 9, 1990

[30] Foreign Application Priority Data

Mar. 9, 1989 [DE] Fed. Rep. of Germany ..... 3907564

[51] Int. Cl.[5] ..... C22C 19/05

[52] U.S. Cl. ..... 420/442; 420/443; 420/446; 420/451; 420/452; 420/453; 420/454; 420/455; 420/459

[58] Field of Search ..... 420/452, 446, 455, 443, 420/451, 453, 454

[56] References Cited

U.S. PATENT DOCUMENTS 4,400,210 8/1983 Kudo et al. ..... 420/452
4,400,211 8/1983 Kudo et al. ..... 420/452
4,421,571 12/1983 Kudo et al. ..... 420/452

*Primary Examiner*—John P. Sheehan

*Assistant Examiner*—Robert R. Koehler

*Attorney, Agent, or Firm*—Michael J. Striker

[57] ABSTRACT

A heat-deformable, austenitic nickel-chromium-iron alloy with high oxidation resistance and thermal strength, comprises 17 up to 25 % Fe
14 up to 20 % Cr
0.5 up to 2.0 % Si
0.1 up to 2.0 % Mn
0.04 up to 0.10 % C
0.02 up to 0.10 % Ca
0.010 up to 0.080 % N
0.025 up to 0.045 % Ti
0.04 up to 0.17 % Zr
0.03 up to 0.08 % Y
less than 0.010 % S
less than 0.015 % P
each less than 0.1 % Mo, W, Co
each less than 0.05 % Nb, Ta, Al, V, Cu
rest Ni with the feature, that the nitrogen content is adjusted in accordance with the following formula:

$$\% N = (0.15 \text{ up to } 0.30) \times \% Zr + (0.30 \text{ up to } 0.60) \times \% Ti.$$

3 Claims, 4 Drawing Sheets

HEAT-DEFORMABLE, AUSTENITIC NICKEL-CHROMIUM-IRON ALLOY WITH HIGH OXIDATION RESISTANCE AND THERMAL STRENGTH

BACKGROUND OF THE INVENTION

The present invention relates to a heat-deformable, austenitic nickel-chromium-iron alloy with very high oxidation resistance and thermal strength.

Such alloys are used for production of wires and bands for heating conductor-resistors, for production of support systems in ovens, as well as for other oven parts, and in increased volumes also for core reactors.

An alloy for support systems in ovens is disclosed for example in the German document DE-PS 3,037,209 and has the following composition:

8 up to 25% chromium
2.5 up to 8% aluminum
0.005 up to 0.04% yttrium
up to 15% of one or several elements Mo, Rh, Hf, W, Ta and Nb
up to 0.5% of one or several elements of C, B, Mg, Zr and Ca
up to 1% Si, up to 2% Mn, up to 20% Co, up to 5% Ti, up to 30% Fe, the rest Ni.

Thereby first of all a highly adhesive aluminum oxide layer is obtained, which preferably is produced by preoxidation in oxygen-containing atmosphere at 1093° C. An aluminum content of 2.5–8% produces in this alloy however a strong $\gamma'$-separation, preferably in the temperature region of 600–800° C. This is connected with a strong ductility reduction of the material, and in the ovens which often during heating and cooling pass this temperature region, can lead to material damages.

Moreover, the aluminum contents of 2.5 to 8% at chromium contents of 8 to 25% are not sufficient to form exclusively aluminum oxide in NiCrAl-alloys. Furthermore, for formation of aluminum oxide, chromium oxide, mixed oxides and inner oxidation, a process is used which especially at temperature-cyclical loads lead to a worsened protective action than the pure chromium oxide.

Another heat resistant and highly thermally deformable alloy is disclosed in U.S. Pat. No. 3,865,581 and has the following composition:

0.01 up to 0.5% C
0.01 up to 2% Si
0.01 up to 3% Mn
22 up to 80% Ni
10 up to 40% Cr
0.0005 up to 0.20% B and/or
0.001 up to 6% Zr as well as
0.001 up to 0.5% Ce and/or
0.001 up to 0.2% Mg and/or
0.001 up to 1% Be
rest iron.

In accordance with claim 2 of this patent, the alloy can contain also Ti, Al and Y.

By the dosed addition of B, Zr, Ce, Mg and Be, the number of effectually exceeding torsions at 1050 to 1300° C. is considerably increased, therefore it can directly connected with the improvement of the thermal deformability. In this alloy it was considered as disadvantageous that the improvement of the thermal deformability detected in short time torsion test leads to burdens of long time properties such as for example oxidation strength. So it is for example known that B, Mg and Be worsen the oxidation properties of the material by modification of the oxide layer during thermal-cycical oxidation. The positive action of cerium was lost at temperatures above 1200° C by the formation of a low-melting eutektic. The positive influence of zirconium on the oxidation strength is neutralized when zirconium for improvement of the thermal deformability is present as stabile carbide. Moreover, the positive influence of zirconium on the thermal deformability properties can be reversed when coarsely dispersed separated zirconium carbide forms by not adjusted zirconium and carbon admixtures.

Finally, DIN 17,742 (Material No. 2.4867) discloses an alloy with max. 0.15% C
max. 0.3% Al
14 up to 19% Cr
max. 0.5% Cu
19 up to 25% Fe
max. 2.0% Mn
0.5 up to 2.0% Si and
at least 59% Ni (including 1% Co).

This alloy is produced in form of wires and bands for manufacturing heat conductors and electrical resistors. It is produced and sold with the following composition:

up to 0.08% C
0.1 up to 0.2% Al
14.0 up to 16.0% Cr
up to 0.5% Cu
19.0 up to 23.0% Fe
0.1 up to 0.8% Mn
1.1 up to 1.6% Si
0.001 up to 0.04% Ca
up to 0.05% N
up to 0.01% S
up to 0.015% P
0.01 up to 0.04% lanthanide as cerium-misch metal
rest nickel.

These heating conductor alloys are shortly identified as NiCr 60 15. It has under the temperature alternate load (in accordance with FIG. 1*b*, so below) the service life lying between that of the pure NiCr-alloy NiCr 80 20 on the one hand, and that of the iron-base material NiCr 30 20 on the other hand (see FIG. 2). Moreover, the alloy NiCr 60 15 despite its higher melting point has a lower maximum use temperature than the pure NiCr alloy and has no sufficient thermal strength or certain applications.

SUMMARY OF THE INVENTION

Accordingly, it is an object of the present invention to improve the known alloy NiCr 60 15 with respect to the use temperature, the service life and the thermal strength so that it can compete with the pure NiCr alloys without increasing its manufacturing cost to the level of these alloys.

In keeping with these objects and with others which will become apparent hereinafter, one feature of the present invention resides, briefly stated, in an alloy which has the following composition (% by weight):

17 up to 25% Fe
14 up to 20% Cr
0.5 up to 2.0% Si
0.1 up to 2.0% Mn
0.04 up to 0.10% C
0.02 up to 0.10% Ca
0.010 up to 0.080% N 0.025 up to 0.045% Ti
0.04 up to 0.17% Zr
0.03 up to 0.08% Y
less than 0.010% S
less than 0.015% P
each less than 0.1% Mo, W, Co
each less than 0.05% Nb, Ta, Al, V, Cu
rest nickel
with the feature that the nitrogen content is adjusted in accordance with the following formula:

$$\% N = (0.15 \text{ up to } 0.30) \times \% Zr + (0.30 \text{ up to } 0.60) \times \% Ti$$

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

In accordance with the present invention a heat deformable austenitic nickel-chromium-iron alloy is proposed. The alloy has the following composition:
17 up to 25% Fe
14 up to 20% Cr
0.5 up to 2.0% Si
0.1 up to 2.0% Mn
0.04 up to 0.10% C
0.02 up to 0.10% Ca
0.010 up to 0.080% N
0.025 up to 0.045% Ti
0.04 up to 0.17% Zr
0.03 up to 0.08% Y
less than 0.010% S
less than 0.015% P
each less than 0.1% Mo, W, Co
each less than 0.05% Nb, Ta, Al, V, Cu
rest nickel
with the feature that the nitrogen content is adjusted in accordance with the following formula:

$$\% N = (0.15 \text{ up to } 0.30) \times \% Zr + (0.30 \text{ up to } 0.60) \times \% Ti$$

During the extensive works for improving the commercially available NiCr 60 15, it was determined in a surprising manner that the conventional use temperature limited maximum to 1200° C. can be increased by approximately 50° C. when the lanthanide utilized in accordance with the prior art as an alloying element in the form of cerium-misch metal is replaced with yttrium. At the thusly higher temperature load of the material, advantageously a further narrowing of the alloy composition is carried out. This composition can be for example:
19 up to 25% Fe
14 up to 20% Cr
0.5 up to 2.0% Si
0.1 up to 0.4% Mn
0.04 up to 0.08% C
0.02 up to 0.05% Ca
0.018 up to 0.06% N
0.035 up to 0.045% Ti
0.06 up to 0.10% Zr
0.03 up to 0.08% Y
less than 0.005% S
less than 0.015% P
each less than 0.1% Mo, W, Co
each less than 0.05% Nb, Ta, Al, V, Cu
rest Ni
with the feature that the nitrogen content is adjusted in accordance with the following formula:

$$\% N = (0.15 \text{ up to } 0.30) \times \% Zr + (0.30 \text{ up to } 0.60) \times \% Ti$$

Also, this composition can be:
19 up to 21% Fe
18 up to 20% Cr
1.3 up to 1.5% Si
0.1 up to 0.4% Mn
0.04 up to 0.06% C
0.03 up to 0.04% Ca
0.018 up to 0.042% N
0.035 up to 0.045% Ti
0.06 up to 0.08% Zr
0.03 up to 0.08% Y
less than 0.005% S
less than 0.015% P
each less than 0.1% Mo, W, Co
each less than 0.05% Nb, Ta, Al, V, Cu
rest Ni
with the feature that the nitrogen content is adjusted in accordance with the following formula:

$$\% N = (0.15 \text{ up to } 0.25) \times \% Zr + (0.30 \text{ up to } 0.45) \times \% Ti$$

By the adjustment of the chromium content in the upper region in accordance with the last mentioned composition, the relatively high chromium oxide evaporation at high temperatures is compensated better, and the narrowing of the sulfur content provides for a significantly improved adhesive strength of the oxide on the surface of the material, so that the oxidation strength and the service life is increased.

Figure 1A:
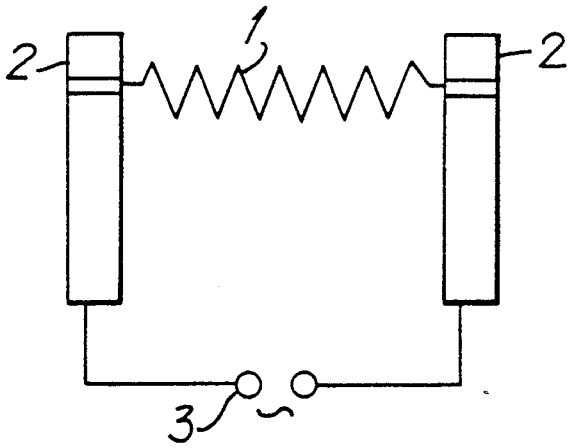
FIG. 1*a* shows an arrangement for testing the service life of a horizontally arranged helically wound heating conductor.

The arrangement for testing the service life of a horizontally arranged, helically wound heating conductor 1 which is schematically shown in FIG. 1*a* is clamped at its end side in a holder 2 and connected with a voltage source 3. In the present case the heating conductor is composed of a 50 mm long coil with 12 convolutions and an inner diameter of 3 mm. The wire diameter amounts to 0.4 mm. The heating conductor is alternatingly turned on and turned off every 2 minutes. The maximal reached temperatures in the heating phase are measured in a contactless manner by means of a radiation parameter and regulated by changing the applied voltage to a constant value.

Such experiments were conducted in normal atmosphere up to through-burning of the heating conductor, and the number of the cycles corresponds to a direct value for the service life. The more or less strong oxidation which is unavoidable for all materials led to the fact that the metallic cross-section available for conducting the electric current became smaller with elapsing of the time. The electrical resistance correspondingly increased and a predetermined maximal temperature could be maintained at unchanged switching rhythm only when the voltage was increased. The utilized testing apparatus was an automatically operating temperature regulating device, so that the predetermined maximal temperature during the total testing time could be maintained up to the through-burning independently from the progressing oxidation of the heating conductor.

Figure 1B:
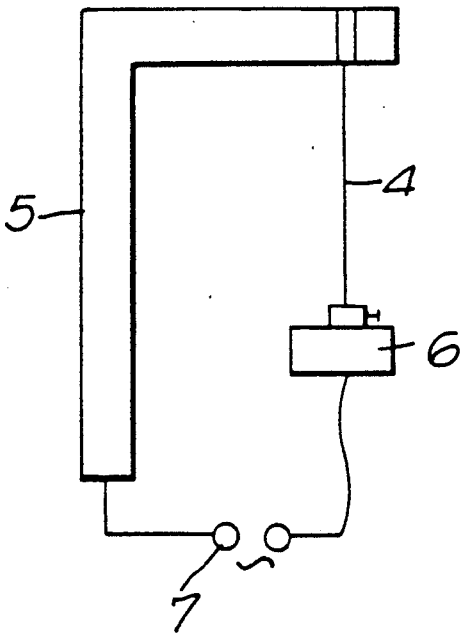
FIG. 1*b* is a view showing an arrangement for testing the service life of a vertically suspended heating conductor wire.

In the arrangement for testing of the service life shown in FIG. 1*b* a vertically suspended heating conductor wire 4 of 1 meter length was used. It was clamped with its upper end in a holder 5, loaded with a variable weight 6 and connected with a voltage source 7. In this device a heating wire with the thickness of 0.4 mm can be alternatingly switched on and switched off every 2 minutes. Here also, as in the device of FIG. 1*a*, the maximal achieved temperature was measured in a contactless manner and regulated to a constant value.

Figure 2:
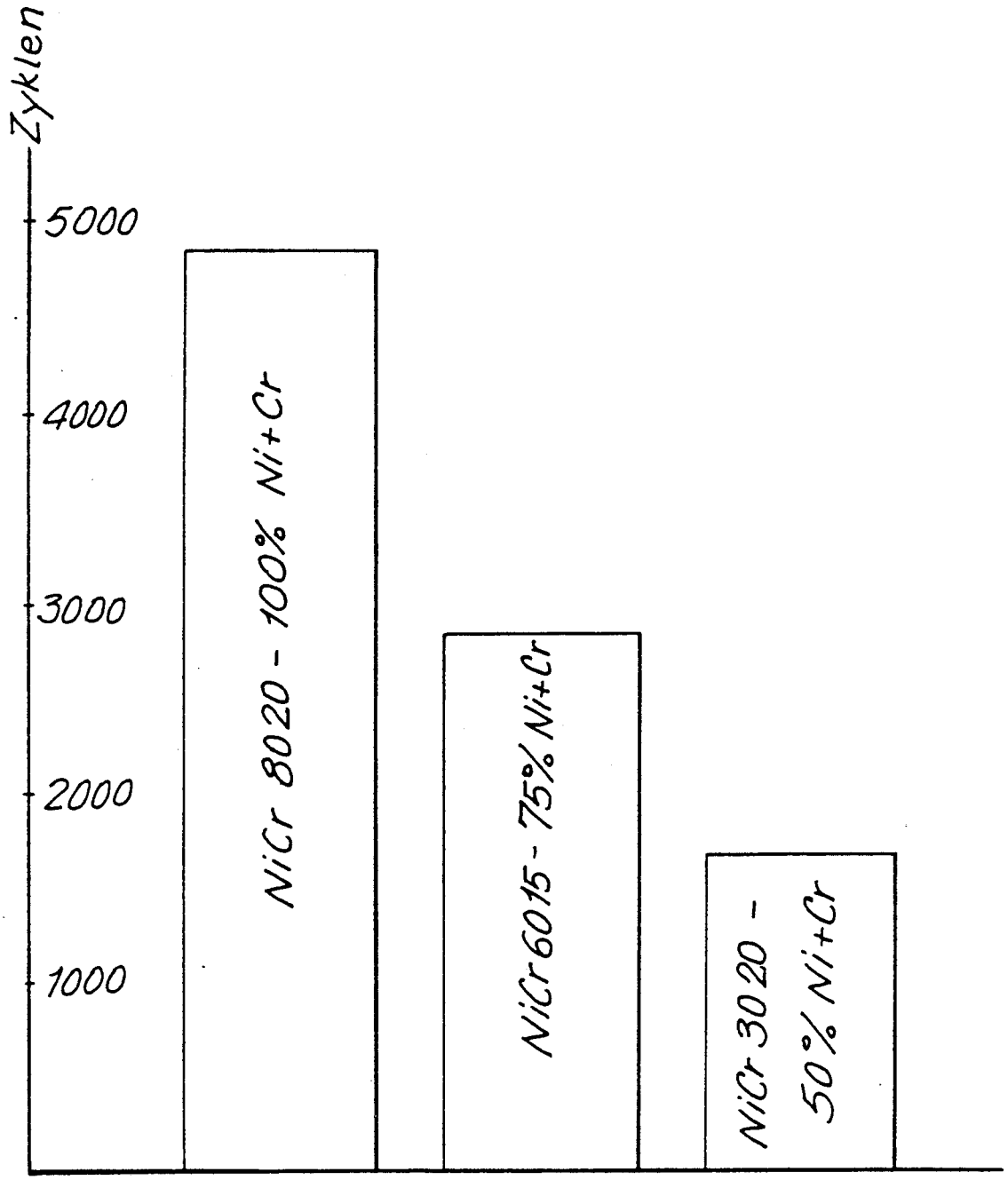
FIG. 2 is a view showing a qualitative comparison of different nickel-chromium materials in accordance with the prior art.
Figure 3:
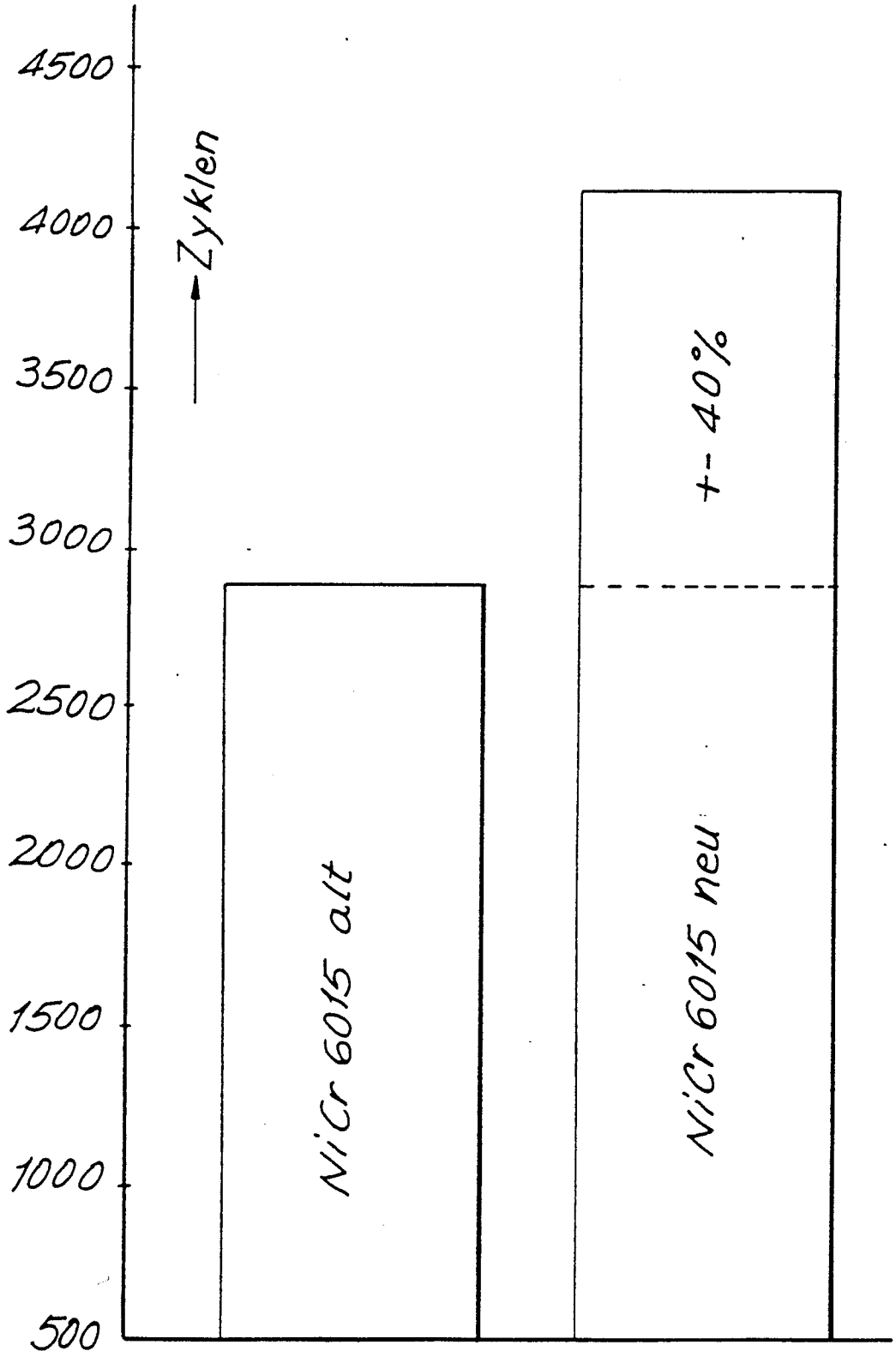
FIG. 3 is a view showing a service life of the inventive material determined the arrangement of FIG. 1*a*.

While FIG. 2 shows only a merely qualitative comparison of different nickel-chromium materials in accordance with the prior art, FIG. 3 shows the service life of the inventive material determined with the arrangement of FIG. 1*a* at a maximal temperature adjusted to 1150° C., compared with the service life of the non-modified material "NiCr 60 15 old", measured under the same conditions. The service life could be increased from 2900 cycles to 4100 cycles, which corresponds to an improvement of over 40%.

In a different testing series the service life (number of cycles) was determined at temperatures of 1150° C., 1200° C. and 1250° C. Table 1 shows that the modified alloy at all temperatures is considerably better. The differences amount to +56.8% at 1150° C., +33.9% at 1200° C., and +66.2% at 1250° C. It could be said whether the relative improvement of the service life is actually temperature dependent or was constant with the investigated probes. Probably it was determined that with a correspondingly high number of the probes, the improvement in statistical average is almost equally high at all temperatures, whereby a value of at least 30% can be expected.

TABLE 1

| Service life in cyclic service life test | | |
|---|---|---|
| | Service life cycles | |
| Temperature °C. | NiCr 60 15 in accordance with the prior art | NiCR 60 15 in accordance with the invention |
| 1150 | 2640 | 4140 |
| 1200 | 1288 | 1725 |
| 1250 | 542 | 901 |

For the practice it is important that the modified alloy at 1200 or 1250° C. has 65 or 34% the service life of the basic alloy at 1150° C. In view of the short time exceeding of the use temperature this especially shows a considerable safety reserve which in many applications is very desirable.

A very high thermal strength is generally required for heating conductor windings, so that in the event of freely suspended windings the mutual contraction of the windings (sagging) can be avoided. In the alloy NiCr 60 15 the thermal strength is first of all connected with a mixing crystal rigidification of the nickel base structure by Cr and Fe, as well as hardening by carbide. For reinforcing the latter mentioned effect, Ti and Zr as well as N was additionally alloyed, so that the modified alloy contains nitride and carbonitride in addition to the carbides. It has been shown in a surprising manner that practically no coarse separation was formed and the separation was very stable and did not lead to growth as long as titanium, zirconium and nitrogen were added in the inventive ratios.

Figure 4:
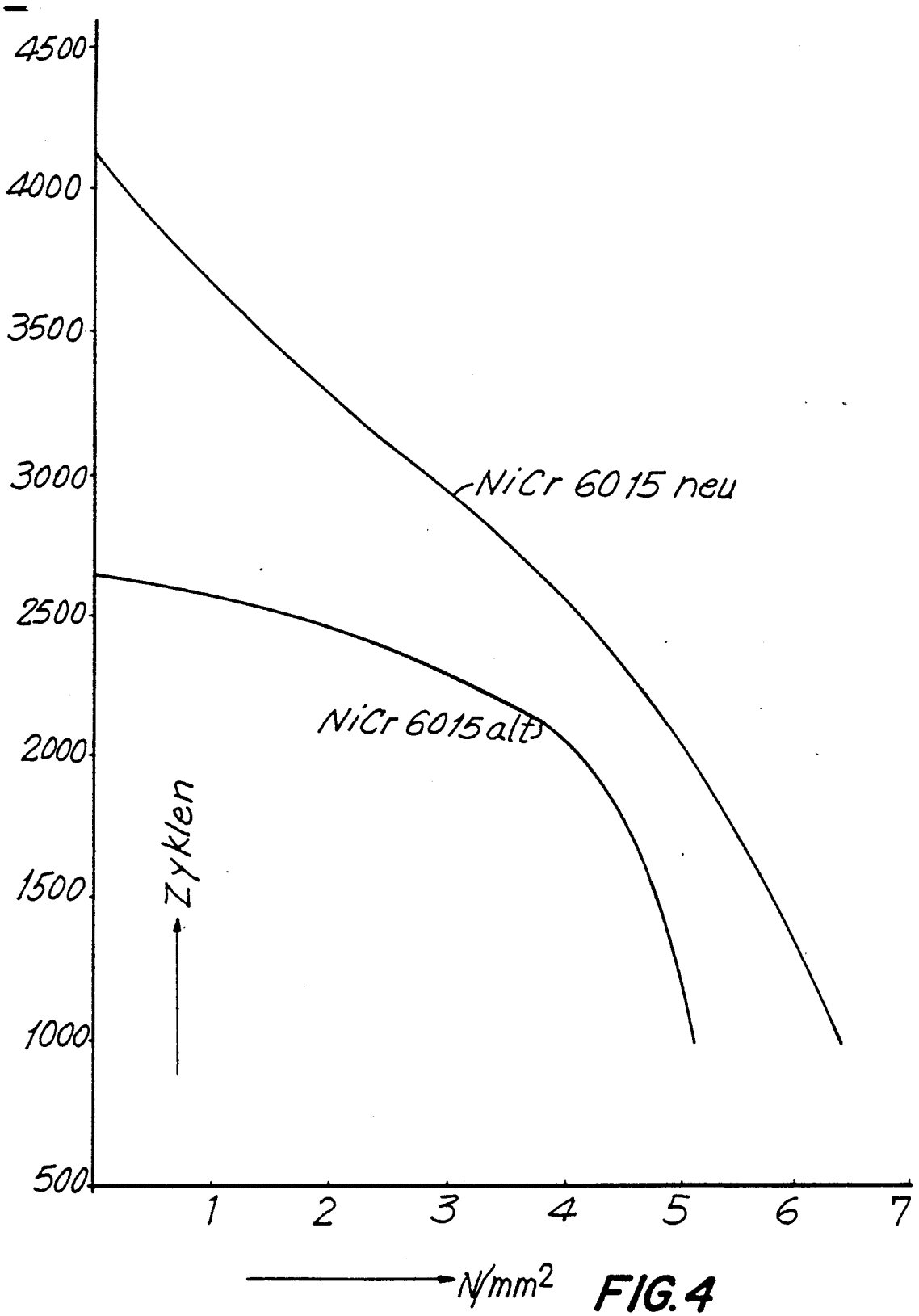
FIG. 4 is a view showing a service life of respective alloys.

FIG. 4 shows the values of the service life (cycles) for "NiCr 60 15 old" and "NiCr 6015 new" determined in the arrangement of FIG. 1*b* over the loading. The adjusted maximal temperature again amounted to 1150° C. and "NiCr 60 15 new" had in the total investigative region considerably better values than the conventional alloy "NiCR 60 15 old".

Also, in an application oriented test the modified material showed a considerably higher service life. Two complete heating elements such as for example those used for cloth dryers were utilized, loaded in cycles of 30 seconds with 227 volt, and in a new heating element a maximum temperature of 1150° C. was reached. While the comparing alloy "NiCr 60 15 old" withstood only approximately 130,000 cycles, the inventive alloy "NiCr 60 15 new" maintained in a not shown test more than 380,000 cycles. Thereby approximately a triple increase of the service life was obtained. This corresponds to a significant and efficient importance of the inventive alloy.

It will be understood that each of the elements described above, or two or more together, may also find a useful application in other types of alloys differing from the types described above.

While the invention has been illustrated and described as embodied in a heat-deformable, austenitic nickel-chromium-iron alloy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A heat-deformable, austenitic nickel-chromium-iron alloy with high oxidation resistance and thermal strength, comprising (% by weight)

17 up to 25% Fe
14 up to 20% Cr
0.5 up to 2.0% Si
0.1 up to 2.0% Mn
0.04 up to 0.10% C
0.02 up to 0.10% Ca
0.010 up to 0.080% N
0.025 up to 0.045% Ti
0.04 up to 0.17% Zr 0.03 up to 0.08% Y
less than 0.010% S
less than 0.015% P
each less than 0.1% Mo, W, Co
each less than 0.05% Nb, Ta, Al, V, Cu
rest Ni with the feature, that the nitrogen content is adjusted in accordance with the following formula:

$$\% N = (0.15 \text{ up to } 0.30) \times \% Zr + (0.30 \text{ up to } 0.60) \times \% Ti$$

2. A nickel-chromium-iron alloy as defined in claim 1, comprising:

19 up to 25% Fe
14 up to 20% Cr
0.5 up to 2.0% Si
0.1 up to 0.4% Mn
0.04 up to 0.08% C
0.02 up to 0.05% Ca
0.018 up to 0.06% N
0.035 up to 0.045% Ti
0.06 up to 0.10% Zr
0.03 up to 0.08% Y
less than 0.005% S
less than 0.015% P
each less than 0.1% Mo, W, Co
each less than 0.05% Nb, Ta, Al, V, Cu
rest Ni with the feature that the nitrogen content is adjusted in accordance with the following formula:

$$\% N = (0.15 \text{ up to } 0.30) \times \% Zr + (0.30 \text{ up to } 0.60) \times \% Ti$$

3. A nickel-chromium-iron alloy as defined in claim 1, comprising:

19 up to 21% Fe
18 up to 20% Cr
1.3 up to 1.5% Si
0.1 up to 0.4% Mn
0.04 up to 0.06% C
0.03 up to 0.04% Ca
0.018 up to 0.042% N
0.035 up to 0.045% Ti
0.06 up to 0.08% Zr
0.03 up to 0.08% Y
less than 0.005% S
less than 0.015% P
each less than 0.1% Mo, W, Co
each less than 0.05% Nb, Ta, Al, V, Cu
rest Ni with the feature that the nitrogen content is adjusted in accordance with the following formula:

$$\% N = (0.15 \text{ up to } 0.25) \times \% Zr + (0.30 \text{ up to } 0.45) \times \% Ti$$

* * * * *